US009183820B1

(12) United States Patent
Adnitt et al.

(10) Patent No.: US 9,183,820 B1
(45) Date of Patent: Nov. 10, 2015

(54) ELECTRONIC MUSIC INSTRUMENT AND METHOD FOR CONTROLLING AN ELECTRONIC MUSIC INSTRUMENT

(71) Applicant: NATIVE INSTRUMENTS GmbH, Berlin (DE)

(72) Inventors: Tim Adnitt, London (GB); Matthias Buese, Berlin (DE); Dinos Vallianatos, Berlin (DE)

(73) Assignee: NATIVE INSTRUMENTS GMBH, Berlin (DE)

( * ) Notice: Subject to any disclaimer, the term of this patent is extended or adjusted under 35 U.S.C. 154(b) by 0 days.

(21) Appl. No.: 14/474,537

(22) Filed: Sep. 2, 2014

(51) Int. Cl.
*G10H 1/20* (2006.01)
*G10H 1/34* (2006.01)
*G10H 1/00* (2006.01)

(52) U.S. Cl.
CPC ..... *G10H 1/20* (2013.01); *G10H 1/0066* (2013.01); *G10H 1/34* (2013.01); *G10H 2220/221* (2013.01)

(58) Field of Classification Search
USPC ..... 84/619, 657
IPC ..... G10H 1/20,1/34
See application file for complete search history.

(56) References Cited

U.S. PATENT DOCUMENTS 5,083,493 A * 1/1992 Heo ..... G10H 1/20 84/445
5,099,738 A * 3/1992 Hotz ..... G10H 1/0075 84/617
5,206,447 A * 4/1993 Yamaguchi ..... G10H 1/40 84/635
5,496,963 A * 3/1996 Ito ..... G10H 1/186 84/478
5,756,917 A * 5/1998 Watanabe ..... G10H 1/36 84/634
6,011,210 A * 1/2000 Haruyama ..... G09B 15/005 84/464 A
2002/0017187 A1* 2/2002 Takahashi ..... G09B 15/023 84/478
2002/0178896 A1* 12/2002 George ..... G09B 15/026 84/477 R
2003/0151628 A1* 8/2003 Salter ..... G09B 5/06 715/773
2004/0074376 A1* 4/2004 Varme ..... G10G 1/00 84/483.2
2004/0168564 A1* 9/2004 Koseki ..... G10H 1/18 84/615
2004/0231500 A1* 11/2004 Sim ..... G10H 1/34 84/719
2006/0181537 A1* 8/2006 Vasan ..... G06T 13/20 345/473
2008/0072738 A1* 3/2008 Plamondon ..... G10G 1/00 84/423 R
2008/0072742 A1* 3/2008 Nishida ..... G10H 1/24 84/615
2008/0072744 A1* 3/2008 Ito ..... G10H 1/28 84/638
2009/0031884 A1* 2/2009 Arai ..... G09B 15/002 84/609
2009/0252327 A1* 10/2009 Ciet ..... H04L 9/002 380/277
2010/0224051 A1* 9/2010 Kurebayashi ..... G10H 1/22 84/637
2010/0307319 A1* 12/2010 Kani ..... G10G 1/02 84/485 R
2011/0185882 A1* 8/2011 Okuda ..... G10H 7/00 84/622
2012/0278358 A1* 11/2012 Watanabe ..... G06F 17/30743 707/769
2014/0260898 A1* 9/2014 Bales ..... G09B 15/026 84/433
2014/0305284 A1* 10/2014 Cosgrove ..... G09B 15/001 84/478

* cited by examiner

*Primary Examiner* — David Warren
(74) *Attorney, Agent, or Firm* — Novak Druce Connolly Bove + Quigg LLP

(57) ABSTRACT

An electronic music instrument comprises an input device having a plurality of input elements configured for generating at least one digital signal corresponding to a particular note when activated, the input device configured to be organized in sounding input elements and non-sounding control input elements and configured for transposing a range of input elements to an intended range of notes; and a software module, wherein the software module is configured for receiving a transposition state of then input device and for remapping the control input elements according to the transposition state.

18 Claims, 2 Drawing Sheets

Figure 1:
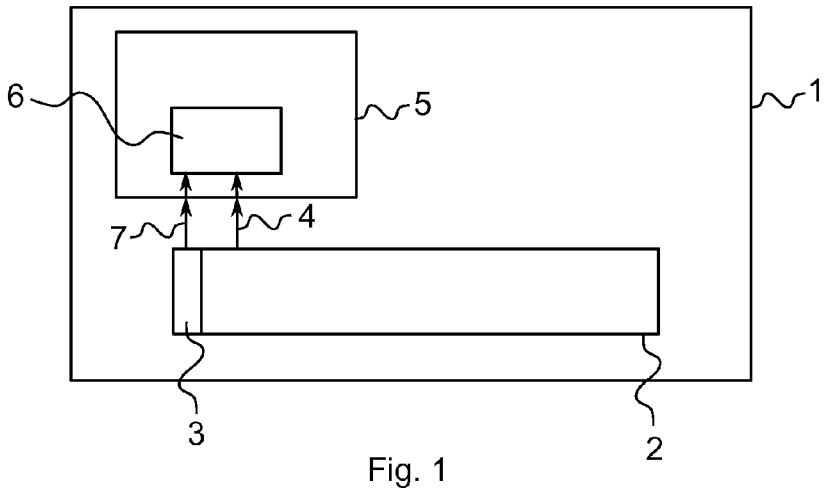

ELECTRONIC MUSIC INSTRUMENT AND METHOD FOR CONTROLLING AN ELECTRONIC MUSIC INSTRUMENT

The present invention relates to an electronic music instrument, a method for controlling an electronic music instrument, a computer program and a computer-readable storage medium.

Many electronic music instruments like MIDI (Musical Instrument Digital Interface) keyboard-controlled synthesizers or samplers provide the player with a so-called control octave, which is a range of keys for switching parameters inside the instrument's software. In most cases, this control octave uses low notes to not interfere with the common note range of the instrument. The player commonly plays the instrument with his right hand. By pressing one or more keys, a digital signal corresponding to the one or more played notes is generated. With the left hand the player plays keys of the control octave, thereby controlling the "sound", i.e. switching parameters in the instrument software that affect the sound. The control keys are usually non-sounding keys, i.e. no sound is produced by pressing them alone.

The functionality of the control octave can vary. For example articulation, arpeggios, playing vibratos can be changed, or sound presets can be switched.

As most MIDI keyboards do not cover the complete 127 note MIDI range, the player can transpose the range of the keys on the keyboard by octave intervals to match the intended note range.

For a 25 key keyboard the two octaves represented by the 25 keys can moved or transposed to cover the two lowest up to the two highest octaves in the 127 note MIDI range. The MIDI protocol does, however, not transmit the transposition state of the keyboard to a software or instrument running on a computer or further elements or functions connected to the keyboard.

Thereby arises the problem that by transposing, the instrument's control octave focus can be moved out of the playable range of the keyboard. Then, the functionality of the control octave is not accessible.

This problem is solved according to the invention by an electronic music instrument according to claim 1, a method for controlling an electronic music instrument according to claim 9, a computer program according to claim 17 and a computer-readable storage medium according to claim 18, respectively.

According to an aspect of the present invention an electronic music instrument comprises an input device having a plurality of input elements configured for generating a digital signal corresponding to a particular note when activated, the input device configured to be organized in sounding input elements and non-sounding control input elements and configured for transposing a range of input elements to an intended range of notes; and a software module, wherein the software module is configured for receiving a transposition state of the input device and for remapping the control input elements according to the transposition state.

The electronic music instrument may be a keyboard, synthesizer, DJ controller, pad controller, matrix controller, 4×4 controller, step sequencer, controlling device for music production or the like configured for generating and/or affecting notes or sounds and note or sound events, respectively. The input element may depend on the type or setup of the instrument and may include at least one of the group consisting of a key, a button, a pad or the like. The input elements may be arranged and/or mapped in a chromatic sequence or chromatic scale. The input elements may be arranged in a common functional group.

The electronic instrument can be arranged in a single housing like a keyboard instrument or a synthesizer. It is also possible that the electronic instrument is distributed over more devices or elements like for example a hardware keyboard and a computer on which the software module is executed. The software module can be a plugin or instrument running on computational hardware. The software is aware of the transposition state of the input device, i.e. which particular note is assigned to which input element. This is advantageous in that the software can react to different transposition states and keep the control input elements always in the playable range of the input device. Full player control of the control functions is thus ensured. Furthermore, it is possible to pin or fix the control input elements to distinct input elements of the input device even for different transposition states. Thereby, the player can freely transpose input elements or range of input elements while one or more control input elements always keep their control function. Depending on the size of the input device i.e. the number of input elements, one or more ranges of input elements can be present. The control input elements can directly adjoin each other or can be dispersed over the input device.

The input device may be a keyboard having a plurality of keys configured for generating at least one digital signal corresponding to a particular note event when pressed. The mapping or remapping of control input elements or control keys are beneficial for keyboards, synthesizers or pianos having a hardware keyboard or keybed. These instruments comprise a plurality of keys where orientation might be difficult after transposition. Further, the chromatic sequence or chromatic scale of a keyboard is very suitable for the proposed remapping of the control input elements or control keys according to the transposition state.

The software module may be a software synthesizer or a sample-based instrument. As the synthesizer generates the electric sound signals or waveforms it is advantageous to include the remapping of the control input elements into the software synthesizer. In this way, the necessary calculations can be performed more efficiently.

The range of input elements and a range of the control input elements may each correspond to an octave and the control input elements may be remapped to the lowest selected octave. Here, a control octave is provided to the player of the instrument. All, one or a plurality of the common twelve input elements of the octave can be assigned as control input elements. In reaction to the current transposition state the software module remaps or reassigns the currently selected lowest octave to be the control octave. The player can control the sound with the control octave on the left side of the instrument like a keyboard and play the instrument on the neighboring octave or octaves on the right side of the instrument.

The electronic music instrument may further comprise visual indicators each arranged at an input element and configured for indicating control input elements. By looking at the input elements of the input device in front of him the player can see which input elements are mapped as the control input elements. The player's experience is greatly enhanced as the control functions are directly evident from the input device. No looks towards a control screen of a computer or the like are necessary to assess the control functions. As a first advantage it is possible to mark control input elements. Second, the function or the functional group can also be indicated for each input element.

The electronic music instrument may further comprise an RGB LED for each input element, the RGB LEDs being configured for color coding the sounding input elements and the non-sounding control input elements. The color coding adds a further step in convenience for the player. With one view the player can identify sounding input elements (e.g. blue) and control or function input elements in other colors. This enhanced control input element visualization enables the player to perform without having to memorize the input element-functioning mapping. Further, the colors of the input elements can be matched with screen representations of software for example of a digital audio workstation.

The instrument may be configured for excluding the control input elements from play assistant functions (e.g. an arpeggiator or chorder). Then, the control input elements are passed through a play assistant module or function of the instrument unprocessed. In other words, the input element range of the control input elements is excluded from the event generation in the play assistant functions. An arpeggiator for example can not create notes from control input elements. This way, a state change of the instrument is not accidentally triggered. At the same time the intended state change induced by operation of a control input element can not trigger the arpeggiator and generate audible events.

The instrument may be configured for limiting play assistant functions triggering notes in the range of the control input elements. Hardware coding or a control instance like an arbitrator or a software routine ensures separation of these functional blocks. As a result, unwanted state changes of the instrument are avoided.

According to another aspect of the present invention a method for controlling an electronic music instrument having an input device with a plurality of input elements configured for generating a digital signal corresponding to a particular note when activated, includes transposing a range of input elements to an intended range of notes the input device and remapping non-sounding control input elements according to the transposition state of the input device. As described above, the knowledge of the transposition state allows for remapping of the control input elements so that they always be in the playable range of the input device. Operating errors or accidental misuse due to transposition are eliminated.

The range of input elements and the control input elements may each correspond to an octave and the control input elements may be remapped to the lowest selected octave. Here, a control octave is provided to the player of the input device. In reaction to the current transposition state the software module remaps or reassigns the currently selected lowest octave to be the control octave. The player can control the sound with the control octave on the left side of the input device and play the instrument on the neighboring octave or octaves on the right side of the input device.

The control input elements may be visually indicated which can be achieved by a source of light for example like an LED. Such a visual indication allows for a quick orientation of the instrument's or input device's set up.

At least one parameter of the group of hue, saturation and brightness may be adaptable for the visual indication of the control input elements. These parameters offer a wide range of presentation or display for coding the input elements of the input device.

An RGB LED may be provided for each input element and the sounding input elements and the non-sounding control input elements may be color coded by the RGB LEDs. The color coding facilitates handling of the instrument even more as sounding and non-sounding input elements correspond to different colors. Further, control input elements may be grouped by coding their colors. Similar functions of control input elements may be associated to a similar or the same color. The range of displayed colors is not limited to the colors red, green or blue as emitted by the exemplary RGB LED. The full gamut of colors can be utilized for coding the input elements.

The control input elements may be excluded from play assistant functions in order to prohibit erroneous operation of the instrument. By excluding the control input elements from play assistant functions it is ensured that one input element does not belong to different functionalities, i.e. the control function and the play assistant function. Separating these functions prevents unwanted states of the instrument or of the functions.

Signals from control input elements may be passed through a play assistant function without invoking a function of the play assistant function. A signal from an input element may be passed through a play assistant function first. A note corresponding to a signal from a certain input element may be processed or changed by the play assistant function or module. In other words, the note being outputted by the play assistant function may be a different note than the one inputted, although both signals originate from the identical input element. The output of the play assistant function may then be processed further by other modules, plugins or routines or is saved or sounded. The output of the play assistant function is also directed towards a control module or function for setting up the instrument or it's sound. Leaving the control signals originating from designated control input elements untouched by the play assistant function has the advantage that control functions are not falsified or distorted by the play assistant function.

Control input elements may be arranged to the left and to the right of a range of sounding input elements. Such a layout of the input device eases play as its central portion is provided for playing the sounding input elements or notes while the peripheral portions at the left side and the right side are utilized for controlling the instrument's behavior especially its sound.

According to a further aspect of the present invention a computer program which enables a data processing device, after the computer program has been loaded into memory means of the data processing device, to carry out a method as described above. Such a computer program may be provided for downloading in a data or communication network. The computer program may be downloaded via the internet to computer like for example a digital audio workstation (DAW).

According to an even further aspect of the present invention a computer-readable storage medium on which a program is stored which enables a data processing device, after the program has been loaded into memory means of the data processing device, to carry out a method as described above.

Figure 2:
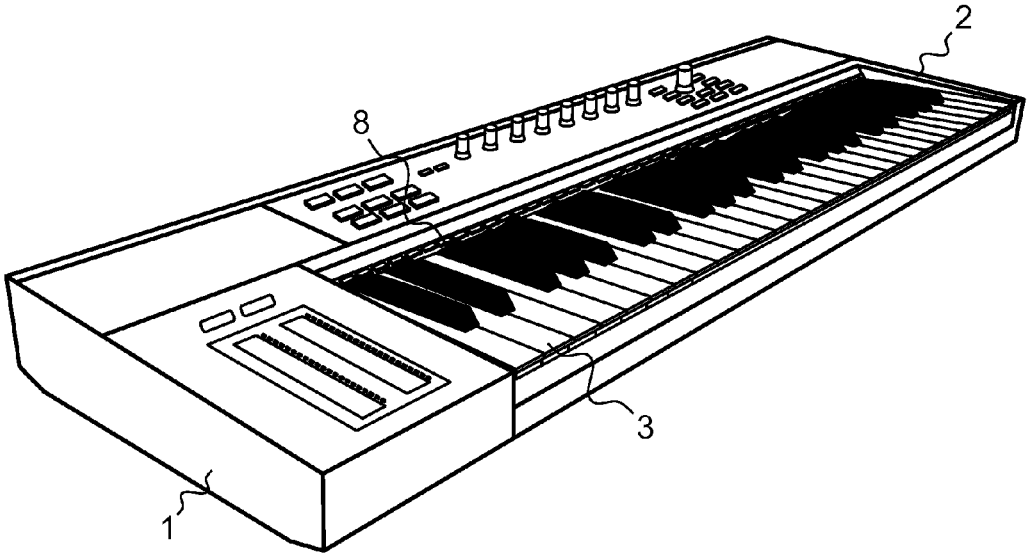
Figure 3:
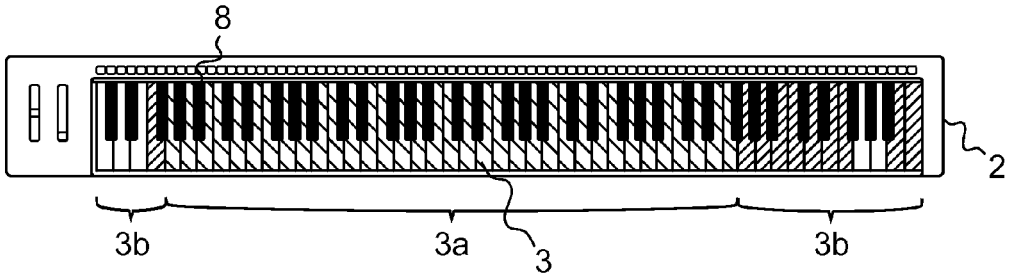

Exemplary embodiments of the invention will now be described in more detail with reference to the Figures which show in FIG. 1 a schematic diagram of the electronic music instrument;

FIG. 2 a spatial representation of the electronic music instrument;

FIG. 3 a plan view of a keyboard of the electronic music instrument; and

Figure 4:
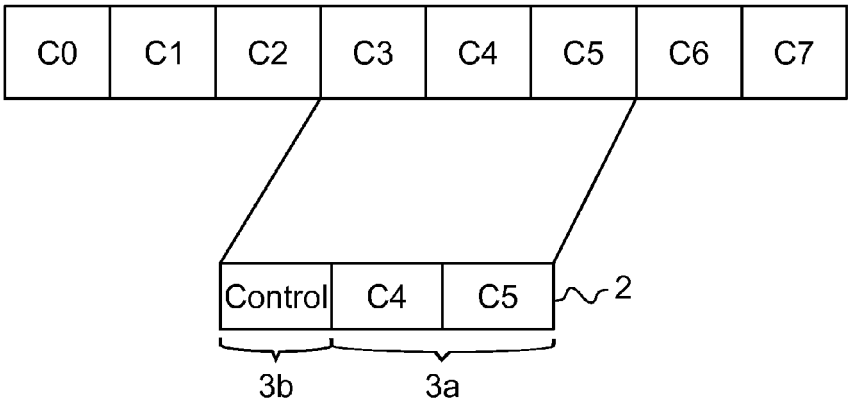

FIG. 4 a schematic diagram of a transposition of keys.

FIG. 1 shows an electronic music instrument 1 as a block diagram. The electronic music instrument may further be a keyboard, synthesizer, DJ controller, pad controller, 4×4 controller, step sequencer or the like configured for generating and/or affecting note or sound events. In the following examples, the electronic music instrument 1 may be a keyboard instrument or synthesizer. Accordingly the instrument 1 has a hardware keyboard 2 with a plurality of keys 3. For the ease of understanding only one key 3 is depicted here. The keyboard 2 may for example include 25, 49 or 61 keys. Other instruments may include keys and/or other input elements like for example buttons of a button matrix or pads of a pad style controller. The following explanations are not only applicable to the explained keyboard, but are valid as well for other electronic music instruments.

Each key 3 generates a signal when it is pressed by a player. Via a communication link 4 like a data line or a bus system the signal is provided to a data processing device 5. The data processing device 5 may be a chip or the like in an enclosure common to the keyboard 2 or a separate device like a computer or a digital audio workstation (DAW). The signal, the communication link 4, protocols and/or interfaces may be compatible to the MIDI standard (Musical Instrument Digital Interface).

The data processing device 5 runs or executes a software module 6 to which the signal is provided. Further, a transposition state 7 is provided from the keyboard 2 to the data processing device 5 and the software module 6. The transposition state 7 indicates which keys 3 or one or mores ranges of keys are transposed to an intended range of notes. The transposition is described in detail in conjunction with FIG. 4.

The software module 6 may encompass further modules, routines, functions or plugins like for example one or more play assistance functions and/or a collection of instrument plugins. According to the signals from the keyboard 2 the software module 6 generates or computes an output signal to be recorded and or played. The functions of the software module 6 may be influenced by internal and/or external modulation engines, oscillators, sequencers, envelope followers or the like.

According to FIG. 2 an embodiment of the instrument 1 is shown. Here, the data processing device (not shown) is integrated in the same housing with the keyboard 2. To each key 3 a visual indicator 8 is assigned. The visual indicators 8 are arranged directly at the respective keys 3. Here, the visual indicators 8 are located at ends of the keys distant to a player. In other words, the visual indicators 8 are arranged in the vicinity to the pivot of the keys 3. As an alternative the keys 3 itself may be illuminated. The visual indicators can be present in the embodiment of FIG. 1 as well.

The visual indicator 8 may include a light emitting diode (LED) advantageously an RGB LED capable of displaying a red, green and blue light. An LED can be directly arranged at a key 3 or inside the instrument 1. In latter case a light guide is present guiding the light to a display element in front of the key 3.

The visual indicator 8 indicates information with regard to the respective key 3. The visual indicator 8 shows whether a key belongs to a sounding key or a non-sounding control key. By pressing a sounding key a signal corresponding to a note or a sequence of notes is generated by the keyboard 2. By pressing a non-sounding control key control functions or parameters of the instrument 1, the keyboard 2, the data processing device 5 and/or the software module 6 are altered or set.

With regard to FIG. 3 the system of sounding keys and non-sounding control keys is explained in more detail. The soundings keys 3*a* or range of sounding keys 3*a* are coded with a certain color for example blue. This is achieved by visual indicators 8 emitting blue light. The non-sounding control keys 3*b* or range of non-sounding control keys 3*b* is coded by another color or even other colors to indicate different control functions or groups of control functions. Articulation, arpeggios, playing vibratos can be changed or sound presets can be switched by pressing one control key 3*b* or a combination of control keys 3*b*.

The mapping of the keys 3 and the visual indicators 8 i.e. the colors or color coding is controlled by the data processing device 5. The player of the instrument 1 knows already at the beginning of his play where the control or function keys 3*b* are located and which functions are assigned.

During play as indicated in FIG. 4 the player can transpose a range of keys to an intended range of notes. Background is that a usual keyboard of an electronic or digital music instrument 1 has lesser keys than a piano or the full MIDI scale of 127 notes. The full MIDI scale or range includes 11 octaves C0 to C10 according to the scientific pitch notation (SPN) mainly used in the U.S. For easier understanding, the first 8 octaves are depicted in FIG. 4. The octave C0 is also named sub-contra octave, the octave C1 is also named contra octave, the octave C2 is also named great octave, the octave C3 is also named small octave, the octave C4 is also named one-line octave or 2nd small octave, the octave C5 is also named two-line octave or 3rd small octave, the octave C6 is also named three-line octave or 4th small octave, the octave C7 is also named four-line octave or 5th small octave.

The exemplary keyboard 2 contains keys for 3 octaves. Hence, transposition is necessary to access the full scale of notes. Via the control keys 3*b* or via further keys or control elements the transposition state is set or configured. The actual transposition state is transferred to the data processing device 5 and/or the software module 6.

Here, as the intended range of notes or intended ranges of notes the three octaves C3, C4 and C5 are chosen. Accordingly, the software module 6 decides how to assign the respective notes to the keys 3. Especially the mapping or remapping of the control keys 3*b* is executed based on the transposition state of the keyboard 2. An important criterion for the remapping process is that the control keys or control octave 3*b* are always in the playable range of the keyboard 2, independent from the transposition state of the keyboard 2.

For the player's convenience the control keys or control octave 3*b* may always remapped to the same physical position of the keyboard 2. Here, the leftmost keys are used. The control keys 3*b* may also be dispersed over the keyboard as indicated in FIG. 3.

Having transposed the keyboard 2 to the three octaves C3, C4 and C5 the software module 6 decides according to the above mentioned criteria that the lowest octave C3 is the control octave with its control keys 3*b*. These control keys 3*b* are mapped to the leftmost keys of the keyboard 2. The two upper octaves C4 and C5 are mapped as the sounding keys 3*a* to the rightmost keys of the keyboard 2.

When the player transposes a range of keys or all keys again, for example to move to octaves C4, C5 and C6 the control octave 3*b* would be moved out of the playable range of the keys of the keyboard in a known instrument.

According to the present invention, the actual transposition state of the keyboard 2 or of it's keys 3 is provided to the data processing device 5 and/or the software module 6 to be taken into account for remapping the control keys 3*b*. According to this function the transposition is not just moved from C3, C4 and C5 to C4, C5 and C6 which would move C3 and with it the mapped control function out of the playable range of keys of the keyboard 2. Instead, the control keys 3*b* are moved to the actual or new lowest octave C4. This pins or fixes the control keys 3*b* to the lowest octave C4 of the selected range C4, C5 and C6 and keeps them in the playable range of keys of the keyboard 2. The player has still full access to the control functions of the instrument 1.

The invention claimed is:

1. An electronic music instrument, the instrument comprising an input device having a plurality of input elements configured for generating at least one digital signal corresponding to a particular note when activated, the input device configured to be organized in sounding input elements and non-sounding control input elements and configured for transposing a range of input elements to an intended range of notes; and a software module, wherein the software module is configured for receiving a transposition state of the input device and for remapping the control input elements according to the transposition state.

2. The electronic music instrument according to claim 1, wherein the input device is a keyboard having a plurality of keys configured for generating at least one digital signal corresponding to a particular note event when pressed.

3. The electronic music instrument according to claim 1, wherein the software module is a software synthesizer or sample-based instrument.

4. The electronic music instrument according to claim 1, wherein the range of input elements and a range of the control input elements each correspond to an octave and wherein the control input elements are remapped to the lowest selected octave.

5. The electronic music instrument according to claim 1, further comprising visual indicators each arranged at an input element and configured for indicating control input elements.

6. The electronic music instrument according to claim 1, further comprising an RGB LED for each input element, the RGB LEDs being configured for color coding the sounding input elements and the non-sounding control input elements.

7. The electronic music instrument according to claim 1, wherein the instrument is configured for excluding the control input elements from play assistant functions.

8. The electronic music instrument according to claim 1, wherein the instrument is configured for limiting play assistant functions triggering notes in the range of the control input elements.

9. A method for controlling an electronic music instrument having an input device with a plurality of input elements configured for generating at least one digital signal corresponding to a particular note when activated, wherein a range of input elements is transposed to an intended range of notes the input device and wherein non-sounding control input elements are remapped according to the transposition state of the input device.

10. The method according to claim 9, wherein the range of input elements and the control input elements each correspond to an octave and wherein the control input elements are remapped to the lowest selected octave.

11. The method according to claim 9, wherein the control input elements are visually indicated.

12. The method according to claim 11, wherein at least one parameter of the group of hue, saturation and brightness is adaptable for the visual indication of the control input elements.

13. The method according to claim 9, wherein an RGB LED is provided for each input element and wherein the sounding input elements and the non-sounding control input elements are color coded by the RGB LEDs.

14. The method according to claim 9, wherein the control input elements are excluded from play assistant functions.

15. The method according to claim 14, wherein signals from control input elements are passed through a play assistant function without invoking a function of the play assistant function.

16. The method according to claim 9, wherein control input elements are arranged to the left and to the right of a range of sounding input elements.

17. A non-transitory computer-readable storage medium on which a program is stored which enables a data processing device, after the computer program has been loaded into memory means of the data processing device, to carry out a method according to claim 9.

18. A non-transitory computer-readable storage medium on which a program is stored which enables a data processing device, after the program has been loaded into memory means of the data processing device, to carry out a method according to claim 9.

* * * * *